United States Patent [19]

Gargrave

[11] Patent Number: 4,535,619

[45] Date of Patent: Aug. 20, 1985

[54] ROTARY BENDING, PARTICULARLY FOR PRESS BRAKES

[76] Inventor: Robert J. Gargrave, 4717 James Hill Rd., Kettering, Ohio 45429

[21] Appl. No.: 433,882

[22] Filed: Oct. 13, 1982

[51] Int. Cl.[3] ..... B21D 37/04

[52] U.S. Cl. ..... 72/481; 72/313; 72/389

[58] Field of Search ..... 72/386, 387, 389, 702, 72/481, 482, 461, 463, 448, 477

[56] References Cited

U.S. PATENT DOCUMENTS

| | | | |
|---|---|---|---|
| 2,314,617 | 3/1943 | Gambino | 72/477 |
| 2,795,983 | 6/1957 | Killius | 72/477 |
| 2,919,613 | 1/1960 | Crement | 72/477 |
| 4,002,049 | 1/1977 | Randolph, Sr. | 72/313 |

FOREIGN PATENT DOCUMENTS

| | | | |
|---|---|---|---|
| 558920 | 4/1960 | France | 72/389 |

OTHER PUBLICATIONS

Cincinnati Shaper Co., *Cincinnati Mechanical Press Brakes,* p. 36.

*Primary Examiner*—Francis S. Husar
*Assistant Examiner*—Linda McLaughlin
*Attorney, Agent, or Firm*—Jerome P. Bloom

[57] ABSTRACT

Rotary bending apparatus provides a die assembly particularly advantageous for use in press brakes featuring a punch embodying a separable part so constructed and arranged as to render it per se capable of providing the punch with any one of a plurality of operating surface portions which differ in configuration by changing its relative orientation and disposition. It also features, in cooperation with and in opposed relation to the punch, an assembly providing a rotary bending tool comprising a notched rotor contained for rotation in and with respect to a saddle, which is contained, in turn, by and for movement relative to a base member in a construction and arrangement wherein the relative position of the saddle and the rotor may be precisely and quickly gaged by a segment of the sheet material to be worked between the punch and the rotor of the opposed rotary bending tool. A preferred mount of the punch and the opposed rotor as the tooling provided in a press brake has the assembly of each thereof backed by a plate the form and nature of which is such to produce a horizontal stiffening of the ram or bed to which it applies. In using the apparatus in a press brake the sheet material to be worked is introduced between the opposed tools at an acute angle to a horizontal.

8 Claims, 5 Drawing Figures

ROTARY BENDING, PARTICULARLY FOR PRESS BRAKES

BACKGROUND OF THE INVENTION

This invention relates to improvements in tools particularly suited for use in bending sheet metal and means for and methods of their application enabling a highly advantageous use thereof in press brakes. It features a forming tool having an interchangeable anvil which offers a quick and simple means and method for making a change in the contour of its operating surface. A further feature of the invention is an improved assembly of a forming tool in the nature of a rotary bender wherein the position of the rocker element thereof may be precisely and easily correlated with the thickness of the stock to be worked.

An additional important feature of the invention is the provision of an arrangement, relative positioning and configuration of the operating elements of tooling for rotary bending which permits working of sheet metal in a press brake without whip up of the stock during a forming operation.

The use and application of rotary benders has been generally foreign to a press brake operation. Those practicing in this particular art have deemed it appropriate and have persisted in the use of conventional rigid "V" blocks and conventional punches to produce the particular bend required in sheet stock. In their procedure the operating end of the punch is shaped as closely as possible to the bend required and the stock is presented in a generally horizontal overlying bridging relation to the "V" shaped notch in the associated block. To achieve any real degree of precision in the bending operation the punch or other forming tool applied to the stock must bottom that portion of the stock to which it applies in the notch of the underlying "V" block. This bottoming procedure requires a lot of tonnage to achieve a reasonable result. The tonnage factor can be reduced by using an "air bending" procedure. However, this procedure will not give a consistent result or as good a result as "bottoming" as far as the accuracy of the bend is concerned.

In any case, since one deals with sheets of material which are large and heavy in use of a press brake, whether a bottoming or air bending procedure is utilized, the operation requires, normally, a considerable amount of manpower. Of greater concern is "whip up" of the stock being inherent in the use of either a bottoming or air bending procedure as heretofore practiced. Operators can and have been seriously injured as a result of whip up, so extreme caution must be used in any instance of a press brake operation in accordance with the prior art.

The present invention not only makes the use of rotary benders more feasible in a press brake operation but enables bends to be achieved, consistently, with a high degree of accuracy and requires substantially less tonnage than that required for "bottoming" in the press brake to accomplish a result equal to or better than may be achieved by a conventional bottoming operation such as above described.

The present invention not only solves the above problems but lends additional benefits in the application of its apparatus to a press brake operation.

Of course the invention method and apparatus may be utilized in other than press brakes. However it is particularly described with reference to press brakes because of the important contributions which it lends to this area of industry.

The inventor does not know of any particular prior art which exhibits the specifics of the present invention as herein claimed. However, reference is made to rotary benders having pertinence to this aspect of the present disclosure as being best represented by that shown and described in U.S. Pat. No. 4,002,049 which issued on Jan. 11, 1977.

SUMMARY OF THE INVENTION

Embodiments of the present invention feature unique components which lend themselves admirably to use in a press brake operation while having advantages which may be utilized otherwise.

By way of example, the present invention features a forming tool the operating end of which includes a releasably attached segment which embodies surface portions differing in configuration. This segment may be selectively mounted to provide particular surface portions thereof as operating portions of the tool in correspondence with the requirements of a particular application. In a preferred embodiment of this tool, suited for use in combination with a rotary bender in a press brake operation, the releasably attached segment has a form the cross section of which generally corresponds to that of a parallelogram, corners of which have a different radius. Per the invention, in its use in a press brake the tool is preferably anchored to a header or base plate which is anchored in turn to provide a horizontal stiffener for the portion of the press brake to which it mounts for a forming operation.

The invention also provides, as a part thereof, an improved assembly of a saddle and rocker element to a base carrier which accommodates their relative movement and permits the position required for the rocker element to be quickly and precisely gaged to the thickness of the stock to be worked. This assembly in combination with the above forming tool of the invention enables a highly versatile and highly efficient die assembly for use in a bending operation in a press brake which is most advantageous in the production of 90° bends in sheet material.

According to a preferred embodiment and practice of the method of the invention, the above described forming tools are so arranged and constructed and so applied in a press brake as to accommodate the movement thereto of the material to be formed at an angle to a horizontal and in any case to provide that in the working of the material in the forming operation there is no whip up. This last enables a press brake operation wherein there is the highest degree of safety for the operators. Apart from this, the manpower required in the use of the method and apparatus of the invention, as will be seen from the example herein described, is minimized. One additional factor derives from the predictable accuracy and consistency of performance of the invention apparatus and that is a better quality product and less scrap due to malfunction or misoperation. One provides thereby a cost effective productivity. Additionally, as will be seen, the invention enables faster changeovers and adjustments as well as a quick adaptation of a particular setup to accommodate a working of a different job and different material.

The invention embodiment as herein illustrated is particularly directed to apparatus and an assembly designed to produce 90° bends in large and heavy sheets of material since this is and has been a critical area of concern in press brake operations. However, it should be readily obvious that the production of various other bends may inherently be provided by adaptations of the structure illustrated.

It is therefore a primary object of the invention to provide improvements in forming tools, setups and method of their use in press brake operations which are economical to achieve, more efficient and satisfactory in their use, adaptable to a variety of applications and unlikely to cause malfunction.

A further object of the invention is to make improvements in forming tools which lend greater versatility in their use.

Another object of the invention is to provide improvements in forming tools, particularly advantageous for use in press brake operations, capable of insuring the production of better parts in shorter periods of time and at lower cost.

Another object of the invention is to provide a method of bending and forming materials and products in a press brake and otherwise which facilitates quick and accurate setup and modifications of the nature and positions of component parts thereof which lend themselves to a most efficient operation.

A further object of the invention is to provide forming tools and a method of forming sheet material, including large and heavy sheet material, particularly advantageous for use in a press brake, which possesses the inherent meritorious characteristics, the advantageous structural features of the apparatus employed and the means and mode of its operation as herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings, wherein is shown one but not the only means and method of the invention, FIG. 1 shows a fragmentary cross sectional, generally schematic, illustration of the tooling of the invention as used in a press brake in a forming of large sections of sheet material, the tooling being shown in a closed position;

Figure 1:
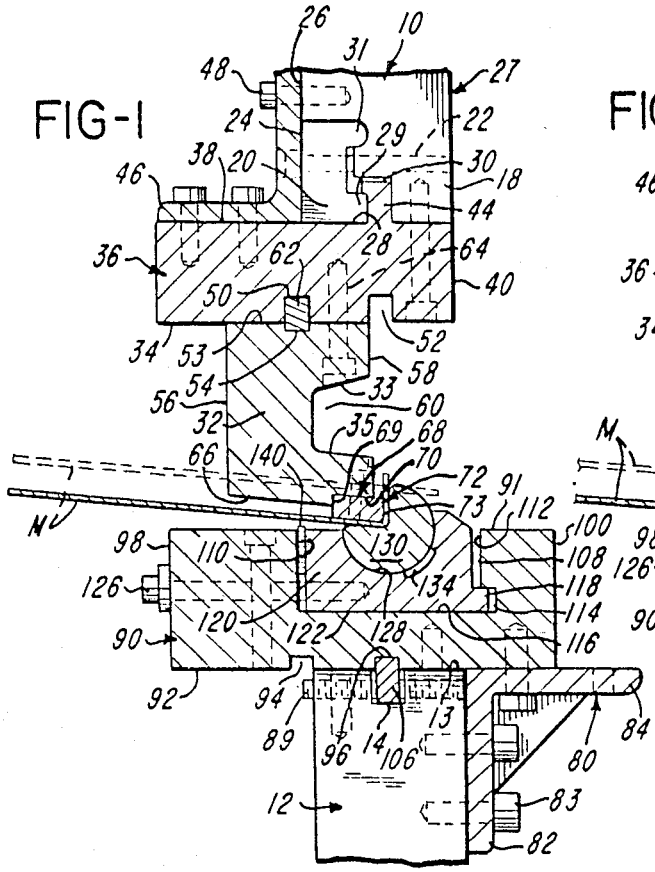
Figure 4:
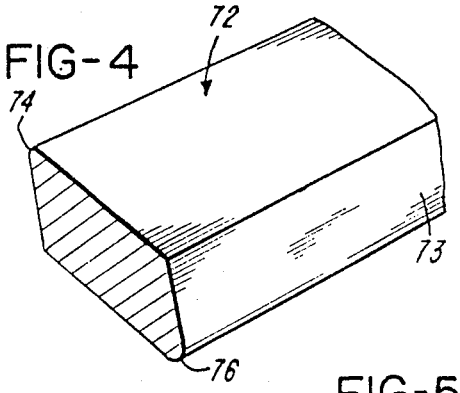
Figure 5:
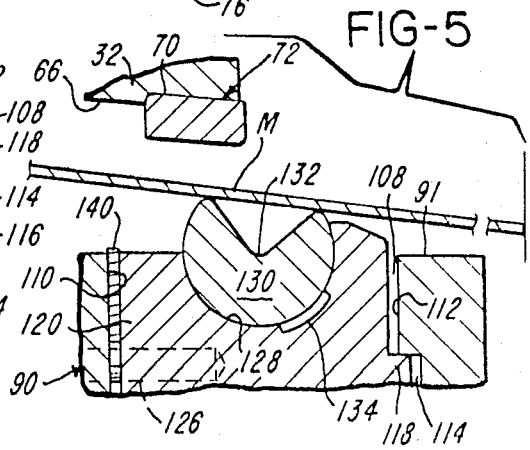

FIG. 4 is a perspective view of a fragment of the interchangeable and reversible segment of the punch portion of the forming tool illustrated which may be selectively oriented in connection therewith to define the operating surface required for the nature and character of its application; and FIG. 5 is a view of the apparatus of FIG. 1 with the tooling in an open position, illustrating the commencement of a bending procedure per the invention;

Like parts are indicated by similar characters of reference throughout the several views.

As is well known in the art, in front view the ram and bed of a press brake are longitudinally extended and substantially coextensive in length and in transverse section (from front to rear) they are quite narrow by comparison with their length.

The drawings reveal opposing portions of a press brake, in transverse section, namely the dependent portion of a ram 10 and a vertically aligned bed 12, from which the ram 10 is normally spaced. The most adjacent facing surface portions of the ram 10 and bed 12 are normally parallel.

As shown, the uppermost surface portion 13 of the bed 12 is conventionally provided with a longitudinally extending, relatively shallow, groove 14 which is perpendicular thereto, rectangular in cross section and centered between and parallel to its front and rear edges. The ram 10 is conventionally constructed to provide that its dependent extremity is a two part structure, one part 18 an integral part of the body of the ram and the other part 20 being mounted to the part 18 by horizontally applied screws 22. The part 20 is a bar, coextensive in length with the ram 10, which in cross section has a generally rectangular U-shaped configuration. The orientation of the bar 20 is such that in its assembly to the part 18 the outer surface 24 of its base forms the lower end portion of the front surface 26 of the ram 10. At the same time the outermost surface 28 of the one (29) of the arms of the "U" shape of the part 20 which is lowermost is co-planar with the part 18 and the plane thereof is parallel to that of the surface portion 13 of the bed 12. As will be seen in the drawings, the surface portion of the part 18 most remote from the surface 24 forms the lowermost end portion of the ram's back surface 27, which is parallel to its front surface 26. The open of the U-shape of the part 20 and that surface portion of the part 18 which it immediately faces are so configured that, as the surface 24 blends in and forms part of the front surface 26 of the ram, the uppermost arm 31 of the part 20 nests in and seats to a complementarily shaped surface portion of the part 18. The remainder of the open end portion of the U-shaped part 20 then defines, with the facing surface portion of the part 18, a rectangular groove 30 in the lowermost surface of the ram 10. As shown in the drawings, the groove 30 is coextensive in length and in a direct vertical alignment with the groove 14. Viewed in cross section the groove 30 has a lateral extension at its upper or innermost limit giving it an inverted "L" shape or rectangular hook shape in transverse section. As will be obvious the part 20 may be easily displaced from the part 18 on an appropriate adjustment of the screws 22.

Referring to the forming tools of the invention, seen in FIG. 1 as parts of a die assembly applied to a press brake, the upper portion or half of the die assembly is basically comprised of a punch 32 secured in dependent relation to the lowermost face 34 of a head or backing plate 36 a portion of the opposite or uppermost face 38 of which is flush abutted to the co-planar lowermost surface portions of the parts 18 and 20 which define the lowermost extremity of the ram 10.

The plate 36 is coextensive in length with the ram, has a substantial depth and is rectangular in transverse section, its width in this respect being substantially greater than its depth. When the plate 36 is secured in place, its rearmost surface face or end 40 forms a co-planar extension of the ram's back surface 27. At the same time, since its transverse width is in this case approximately double that of the ram 10, the plate 36 projects substantially forward of the surface 26 as well as being perpendicular thereto. Formed integral with the plate 36 and extending upwardly from and perpendicular to its uppermost surface 38, along the length thereof, in a parallel relatively closely spaced relation to its back edge, is a projection 44. The projection 44 has a hook form, in transverse section, the shape of which corresponds to that of an inverted "L". In the mount of the plate 36 to the ram, the part 20 is first displaced from the part 18 to accommodate the insertion therebetween of the projection 44, whereupon the part 20 is moved inwardly and seated to the part 18 to contain and clamp the L-shaped projection 44 within the groove 30 and to the ram 10. As will be obvious in the containment of the projection 44 the laterally extended portion thereof, which is uppermost, is hooked over the innermost surface of the lowermost arm 29 of the part 20. The plate 36 is additionally anchored to the ram 10 by application of a length of angle iron 46 one arm of the cross section of which is secured by screws 48 in flush abutment to the surface 26 of the ram 10 and the other arm of which is secured to plate 36 by screws 48 to lie in flush abutment to that portion of surface 38 which projects forwardly of and in a plane perpendicular to that of the surface 26. Further screws 48 are applied through the plate 36 and into the part 18 of the ram 10 in lines adjacent and parallel to the plane of the surface 27 and rearwardly of the groove 30.

The plate 36 has two grooves, respectively 50 and 52, formed in its lowermost surface 34. These grooves are relatively shallow, rectangular in cross section and extend the length of the plate 36 and in a parallel spaced relation to each other and to the front and rearmost surface portions of the plate 36. The groove 50 is centered between the front and rearmost surfaces of the plate 36 and the groove 52 is in a vertical alignment with the projection 44.

The punch 32 of the present invention is a bar, substantially coextensive in length with the plate 36, which in cross section has what is known in the art as a gooseneck form. Its surface 53, which is uppermost as the punch is mounted for use, is flat, has a longitudinally extending groove 54 which is shallow, rectangular in transverse section and centered between and parallel to what may be considered its front and back surfaces 56 and 58 which respectively face to the front and back of the press brake and consequently provide its leading and trailing faces or surfaces, with respect to the direction that material is fed into the press for the forming thereof. The front surface 56 is rectangular and in a plane perpendicular to the plane of the surface 53. The rear surface 58 is perpendicular to the surface 53 and its vertical extent is somewhat greater than that of the surface 56. However, the surface 58 has a recess defining groove 60 to the length thereof at a location centered between and spaced equidistantly from its uppermost and lowermost edges, which are parallel. The groove 60 has bounding side walls 33 and 35 which are outwardly divergent and a base which is parallel to the surface 56.

In the mount of the punch 32, as shown in FIG. 1, its surface 53 is placed in flush abutment with the plate surface 34 and its groove 54 is placed in a direct alignment with the groove 50 to nest therein a complementarily shaped portion of a longitudinally extended locating bar 62 the uppermost portion of which is shaped complementary to and press fit in the groove 50. So located, the body of the punch 32 is fixedly clamped in its abutted, perpendicularly projected, dependent relation to the plate surface 34 by a plurality of screws 64 applied through the upper side wall surface 33 of the groove 60.

As mounted to the plate 36 and the ram 10, in the case illustrated, the lowermost surface portion 66 of the punch 32 is inclined downwardly from its front edge in a plane which departs from a horizontal by an angle of 5°. It is interrupted, however, at a point adjacent and spaced from its back edge, by a shallow notch 68 formed therein at what may be considered the toe of the punch 32.

The notch 68 extends the length of the toe of the punch 32 and it is bounded at the point of its offset from the surface 66 by a shallow side wall portion 69 which is parallel to the surface 56. Its base surface 70 is parallel to the surface 66.

An elongated bar 72 accommodated in the notch 68, the length thereof, seats to its bounding wall surface 69 and 70. In cross (transverse) section the outer surface portions of the bar 72 form a parallelogram at least diagonally opposite corners 74 and 76 of which are differentially radiused. In the example illustrated the radius of the corner 74 is less than that of the corner 76. Furthermore, the depth of the parallelogram of bar 72 is greater than that of the notch 68 and its width is also greater than that of the notch 68. Thus, as the bar 72 is inserted to seat in the notch 68, a portion of its width projects rearwardly and outwardly of the toe of the punch 32 to position its outermost side surface parallel to the surface 69 and another portion thereof projects below and outwardly of the inclined surface portion 66 of the punch to lie in a plane spaced below and parallel to the surfaces 66 and 70. As thus applied the bar 72 serves as an anvil. As thus combined, the punch 32 and the bar 72 provide a single versatile tool the main body portion of which is defined by the punch and the forming portion of which is defined by the anvil which is an extension of its toe. In its position shown in FIG. 1 the outermost side surface 73 of the bar 72 which is displaced outwardly of and to the rear of the back surface 58 of the punch is vertically oriented and lies in the central vertical plane of the ram 10 which is equidistant from and parallel to its surfaces 26 and 27. As may be seen, by virtue of the difference of the radius of its respective corners 74 and 76, the anvil provided by the bar 72 can be selectively installed in connection with the body 32 to provide different forming surfaces and enable one and the same tool to serve different forming functions.

Referring further to FIG. 1, a length of angle iron 80 which is right angled in cross section and reinforced by longitudinally spaced triangular plates has one leg 82 thereof fixed to the back side of the press bed by screws 83 to dispose the uppermost surface of its other leg 84 to form a co-planar extension of the bed surface 13.

A rotary bender assembly per the present invention includes a base plate 90 which has a substantial depth and, in transverse section, a generally rectangular configuration, modified as may be seen from its following description. Viewing the plate 90 from front to back as seen in FIG. 1, it has a mounting surface 92 which is flat save for the formation therein of two grooves 94 and 96 which are rectangular in cross section and in parallel spaced relation to each other and to the plate's front and back surfaces 98 and 100. The groove 96 is centered between the surfaces 98 and 100 while the groove 94 is spaced from the groove 96, in the direction of the front surface 98, a distance approximately half the front to back dimension of the uppermost surface 13 of the press brake bed 12.

In the mount of the plate 90, as seen in the embodiment of FIG. 1, the portion of its base surface 92, the length thereof, between its back surface 100 and the most adjacent side wall of the groove 94 is set over the upper surface 13 of the bed 12 and a portion of the transverse width of the leg 84. An edge mounted rectangular bar 106 has a portion thereof sized and shaped complementary in cross section to that of the groove 96 and press fit therein. The remaining portion of the bar 106 projects from and perpendicular to the surface 92 of the plate 90 to depend in the groove 14 in the surface 13 of the press bed 12. The bar 106 has a width which is narrower than the groove 14 in which it depends. Pairs of aligned set screws 89 applied to the bed 12 through the front and the back surfaces thereof are threadedly engaged therein to project at their inner ends through the front and back walls of the groove 14 to engage to and adjust the front to back position of the bar 106 and correspondingly the position of the plate 90 with reference to the press bed. When so located, the plate 90 is fixed in abutment to the bed 12 by screws 104. As fixed in place, a portion of the plate 90 projects, in part, forwardly of and outwardly from the front surface of the bed 12.

A groove 108, rectangular in cross section, is formed in the upper surface 91 of the plate 90, parallel to its front and back surfaces 98 and 100 and more closely adjacent the back surface 100. Groove 108 is bounded by side walls 110 and 112, the latter being in an adjacent, parallel relation to the surface 100. An offset formed at the base of the side wall 112, in the direction of the surface 100, produces a recess 114 therein which is rectangular in transverse section and expands the transverse width of the groove 108 at its base 116.

Within the groove 108, the length thereof, is a saddle member 120. The saddle member 120 has a planar base surface 122 seating in flush abutment to the base 116. The width of the saddle, in transverse section is less than that of the groove 108 except that at the base of the side thereof adjacent the wall 112 it has an extension 118 along the length thereof which in cross section has a generally rectangular configuration and a depth complementary to that of the recess 114 adapting it to slip fit therein. The configuration of the cross section of the saddle 120, from front to back thereof, and the complementary configuration of the groove 108 necessitates that the saddle be assembled to the plate 90 by its slip fit therein from one end, in the process of which a portion of the extension 118 on the saddle will lodge within the recess 114, in bearing relation to the surfaces which define its vertical limits. Thus, as may be seen from the drawings, the saddle 120 is mounted with a degree of freedom of front to back movement between the side walls 110 and 112 of the groove.

Screws 126 engaged through the front surface 98 of the base plate 90 and into the front side portion of the saddle are set to rotate in place. By virtue of their rotation the screws 126 may be used to adjust the front to back position of the saddle within the limits of the groove 108.

Formed in the upper surface of the saddle 120, the length thereof, is a groove which in cross section is formed on a uniform radius to seat for rotation on its bounding wall surface 128 a rotor 130. The rotor 130 is cylindrical in form and complementary with the surface 128 as to its radial dimension save for a radical notch 132 therein, the length thereof. The arcuate extent of the bounding wall surface 128 is somewhat greater than 180°, the exterior of the bounding wall surface 128 beyond 180° being to the back of the rotor, as seen in the end view thereof shown in the drawings.

Formed in the surface 128, as seen in the drawings, in an area from about 4 to 5:30 clockwise of the arcuate extent thereof, in cross section, is a shallow groove 134 which extends the length of the surface 128 the purpose and benefit of which will be further described.

In cross section the V-shape of the notch 132 has the apex thereof approximately at the center of the rotor 130 and its side walls forming an angle slightly less than 90°, in the case shown an angle of 85°.

Thus, once base plate 90 of the rotary bender assembly is mounted to the bed 12, as describedd, should a closing of the press indicate a need, the assembly does embody means for quickly, easily and precisely relating the rotor or rocker element 130 to the forming portion 72 of the punch 32 to suit its intended application. This enables the tooling to be applied with equal advantage to the working of stock of various thicknesses. Under the conditions noted, to insure a proper relation between the rotor 130 and the forming portion 72 in any particular case a gage in the form of a segment 140 of the sheet material to be worked is inserted to present its thickness between the side wall 110 of the groove 108 and the adjacent side of the saddle. On appropriate adjustment of the saddle by means of the screw 126, the saddle bears against the gage to hold it to the side wall 110. In this position of the saddle the rocker 130 is precisely located to insure repetitive accurate bends in the sheet material of the same thickness which is to be worked between the tooling. In the case illustrated the bends applied to the material worked will be 90°. It should be obvious, however, that the nature and degree of the bend which may be created using the apparatus is not so limited.

Referring now to the use of the tooling above described, attention is directed to FIG. 5 of the drawings which illustrates the press brake and the tooling applied thereto as seen in FIG. 1 but in an open condition. At this point the rotary bender assembly has been previously gaged, using a segment of the material M to be worked to set the rotor 130 to its required position with reference to the forming portion 72 of the punch 32, and in particular the outer vertical surface side portion 73 thereof.

As seen in FIG. 5, the sheet of metal M to be worked is initially inserted in the press brake at an angle to a horizontal which causes it to orient parallel to the surface 66. The leading edge of the sheet M is abutted to a back gage, which determines the depth of the flange to be formed. In the process of its insertion the sheet M is caused to overlie the outer lobes of the rotor or rocker 130, which are defined by the radially outermost edges of the notch 132, to induce them to be disposed in the first instance in correspondence with the angle of inclination of the sheet, in this case 5°.

In the closing of the press brake the bottom portion of the part 72 at the toe of the punch 32 will come down on the sheet M over the trailing lobe of the rotor 130 to rotate the rotor or rocker element 130 counterclockwise. Since, as it contacts the sheet M, the undersurface of the forming portion 72, which serves as an anvil, is at the same angle as the sheet, there is a balanced and full contact thereof to the sheet as the part 72 closes down on the rotor 130 and the leading wall of the notch 132 is rocked down under the portion of the sheet of which is placed under pressure. At the same time the trailing wall of the notch 132 (as referred to the direction of insertion on the sheet M) is caused to have its outer lobe move against the portion of the sheet M which bears thereon to bend the leading end portion of the sheet back, around the edge 76 of the bar 72 and into abutting relation to the surface 73. Since the surface 73 is in the central vertical plane of the ram 10 which is parallel to its front and back surfaces, as the ram is closed what was the upper surface of the bent up portion of sheet M will essentially abut this central vertical plane of the ram. By reason of the angle defined between the surface 73 and the undersurface of the part 72, the angle thereby formed between the bent up and the trailing portion of the sheet will be essentially 85°. The difference between this and 90° will be substantially precisely such in this case, so that on withdrawal of the ram and opening the press, springback will result in the bend being one of 90°.

It will be obvious from the drawings that the upper portion of the saddle 120 projects upwardly from the base plate 90 in which it is contained for front to back adjustment to insure clearance to accommodate the angle of the sheet M to the horizontal as it is inserted for a forming process in accordance with the invention. The application of the sheet M for the forming operation at an angle between 2° and 7° is in any case deemed most desirable.

The use of the apparatus and the practice of the method of the invention in connection with press brakes has proven their unique advantages. The invention provides benefits the degree of which has not heretofore been forseen or deemed possible in the use of a rotary bender in the press brake art. A most important advance enabled in press brake operations is that in the use of the invention apparatus, particularly using the procedure herein described, one can achieve critical 90° bends in a cost effective manner, with a minimum of manpower and an avoidance of dangerous whip up of the material being worked as the press brake closes. A most beneficial feature of the invention apparatus is the provision for a separable multi-faceted part to provide the forming portion of a punch or other forming tool which is used in a press, particularly as used with a rotary bender such as herein illustrated. Furthermore, the construction and arrangement provided enables a fast changeover of tooling. As has been made readily apparent, with a multi-tool complex formed on a separable portion of a punch (herein illustrated by the part 72) one needs only change its orientation with reference to the tool of which it forms a part to adapt it for a different forming of the sheet material to which it applies. The provision of an assembly to embody a rotary bender as herein illustrated is also an improvement feature facilitating precision and accuracy in the forming of large sheet material in a press brake. The gaging procedure available lends benefits in that it helps to avoid poor quality results and scrapping of material such as heretofore occurred in the use of a press brake. As will be obvious, the illustrated rocker assembly also facilitates a quick replacement of the saddle and the rotor.

In any event, the interchangeability of anvils may be achieved in a matter of minutes, to extend, substantially the range of application possible in use of the tooling of the invention.

One inobvious aspect of the approximately 5° presentation of stock for a forming procedure is that it provides for a wedge action in the closing of the tooling which centralizes the application of the bending or forming force and assists in opposing angular forces of the bending action of the rocker 130.

The use of a backing plate 36 such as herein illustrated is highly important where the application indicates a desirability of the stiffening of the ram 10 to protect against bowing thereof in the press brake action. The base 90 similarly stiffens and prevents bowing of the bed 12.

Figure 2:
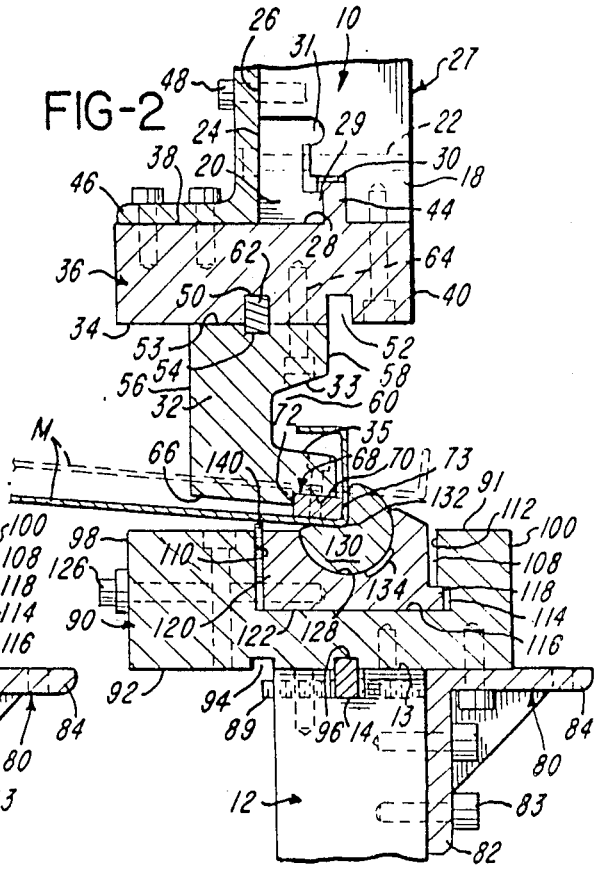
FIG. 2 is an illustration similar to that of FIG. 1 demonstrating a successive bending operation on the same sheet material which is shown as being worked in FIG. 1.

Yet another feature is provided in the invention construction. This is the provision for relief of the surface 128 at 134 which provides an advantageous construction and arrangement of the rotor which enables it to accommodate the forces developed in the closing of the tooling in a bending or forming operation. In any event the invention provides that the rotor 130 may in any case be finally set to stock thickness with ease and precision. With the above in mind, consider the FIGS. 1–3 of the drawings. In FIG. 1 the tools are shown as moved from the open position of FIG. 5 to a closed position to first produce what is intended as a return flange on the leading edge of a sheet M. FIG. 2 illustrates the subsequent advance of the sheet M to a suitably provided back gage when the tooling is opened, at which point the tooling of the press is closed on the sheet to produce a primary flange on the sheet M, on which a return flange has already been formed.

Figure 3:
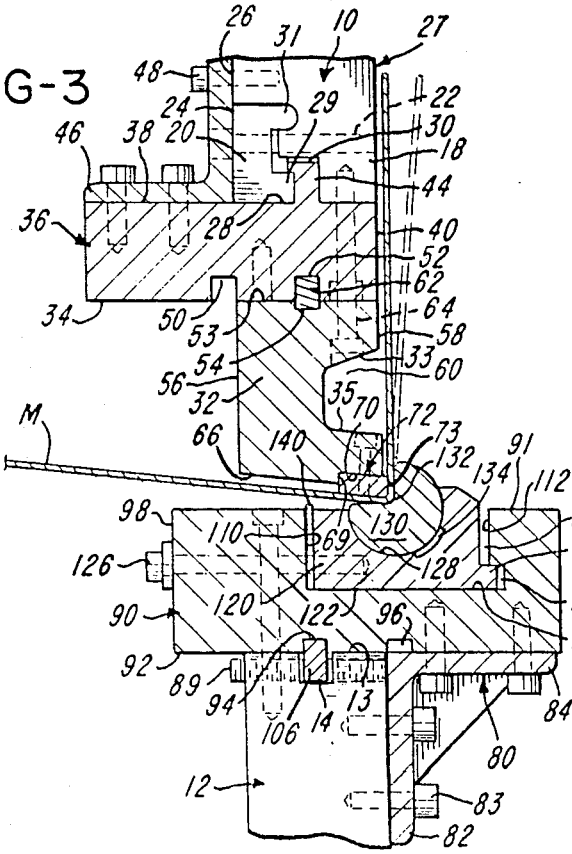
FIG. 3 is a schematic view of the structure illustrated in FIGS. 1 and 2 with respective portions of the die set embodied therein relatively adjusted as to their respective positions to provide for the forming of what may be generally considered, for purpose of this disclosure, a "high flange"

FIG. 3 exhibits the versatility of the mount of the tooling and the benefits of the capability of shifting the upper and lower portions thereof so as to facilitate the production of what is known as a "high flange" on a large sheet of metal. In the embodiment illustrated to this end the punch 32 has been moved to place its surface 58 co-planar with the back surfaces of the ram 10 and the plate 36, in the process of which the groove 54 has been aligned with the groove 52 and the bar 62 inserted in these mating grooves, whereupon the punch has been fastened to the plate 36 and the ram portion 18 by the screws 64. Similarly, the plate 90 has been shifted on the bed 12 to align the grooves 94 and 14 to mutually receive the bar 106 in the manner clearly apparent in the drawings. With the plate 90 so shifted it fully overlies the leg 84 of the element 80 and is fixed thereto by screws. For the high flanging operation, as in the case of any other bending or forming operation using the apparatus of the invention, the required position of the rotor 130 is insured with reference to the forming portion 72 of the punch 32 using a gage 140 corresponding in thickness to that of the sheet metal to be worked.

It is believed that the foregoing exhibits the considerable versatility of the invention apparatus and advance provided thereby in the press brake art as well as an equal benefit which may be afforded in use of the invention as referenced to other press applications.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus providing tooling for a bending and forming of sheet material in a press or press brake, said tooling including two separate halves for connection in a press or press brake to dispose in a relatively opposed normally spaced relation in an open condition thereof and be brought together in a closing condition thereof to produce a bend in and forming of sheet material interposed therebetween, one half of said tooling comprising a forming tool having opposite ends, one of which ends is adapted for connection to a portion of the structure of said press or press brake and the other of which is adapted to project toward and be positioned most adjacent the other of said halves of said tooling which is in an opposed relation thereto, said other of said halves of said tooling comprising a rotary bending tool including a rotor having a notch therein mounted on and for rotation in and with respect to a saddle, said saddle being seated in and for movement relative to a base member, said base member being adapted for the anchoring thereof to another portion of the structure of said press or press brake to position a portion of the notch of said rotor outwardly thereof in an opposed relation to a forming portion of said most adjacent end of said forming tool which is contoured in accordance with the bending and forming operation to be effected on the sheet, means for releasably fixing said saddle and thereby said portion of said notch and the bounding wall surface thereof in one of a plurality of optional positions with reference to said base member and said forming portion of said adjacent end of said forming tool and means for application between adjacent surface portions of said saddle and said base member to determine the said releasably fixed position of said saddle and establish said portion of the notch of said rotor so as to provide that in the closing of said halves of said tooling bounding wall surface portions of said notch, which are made complementary in contour to that of said forming portion of said tool are spaced from said forming portion of said tool a distance corresponding substantially with the thickness of the stock being worked by said tooling.

2. Apparatus providing tooling for a bending and forming of sheet material in a press or press brake, said tooling including two separate halves for connection in a press or press brake to dispose in a relatively opposed normally spaced relation in an open condition thereof and be brought together in a closing condition thereof to produce a bend in and forming of sheet material interposed therebetween, one half of said tooling comprising a forming tool having opposite ends, one of which ends is adapted for connection to a portion of the structure of said press or press brake and the other of which is adapted to project toward and be positioned most adjacent the other of said halves of said tooling which is in an opposed relation thereto, said other of said halves of said tooling comprising a rotary bending tool including a rotor having a notch therein mounted on and for rotation in and with respect to a saddle, said saddle being seated in and for movement relative to a base member, said base member being adapted for the anchoring thereof to another portion of the structure of said press or press brake to position a portion of the notch of said rotor outwardly thereof in an opposed relation to a forming portion of said most adjacent end of said forming tool which is contoured in accordance with the bending and forming operation to be effected on the sheet, means for releasably fixing said saddle and thereby said portion of said notch and the bounding wall surface thereof in one of a plurality of optional positions with reference to said base member and a gage for positioning said saddle with reference to said base member constructed and arranged for insertion between adjacent surfaces thereof to establish the required releasably fixed position of said saddle and the rotor therein with reference to said forming portion of said forming tool, said gauge being a segment of material corresponding in thickness to the thickness of the sheet material on which said rotor is to operate.

3. A method of conducting a forming operation on sheet stock in a press or press brake utilizing a die assembly respective portions of which are respectively mounted to the ram and bed thereof wherein one of said portions of said die assembly comprises a tool including a main body having a head end and an opposite end, the head end of which is connected to the ram of the press or press brake, as the case may be, to position said main body with said opposite end thereof in an outwardly projected relation thereto, said opposite end including a forming portion of said tool, surface portions of which respectively differ in configuration and/or dimension to provide it with a construction conditioning it for use in different forming operations, said main body including a leading face and a trailing face, with reference to the diretion in which material is applied to the press or press brake in the forming thereof, and said opposite end of said main body presenting means defining a surface which is angularly inclined from said leading face to and in the direction of said trailing face, and another portion of said die assembly comprises rotary bending apparatus mounted on and in connection with the bed of the press or press brake including a notched rotor mounted on and for rotation in and with respect to a saddle, said saddle being contained in and for movement relative to a base member to selectively position said rotor and the notch thereof in relation to said forming portion of said tool to provide, on closing of said press or press brake on sheet stock interposed therebetween for forming, that the bounding wall surface portions of said notch, which are made complementary in contour to that of said forming portion of said tool are spaced from said forming portion of said tool in accordance with the thickness of the stock worked characterized by inserting sheet stock to be formed between said forming tool and said rotary bending apparatus and establishing said stock in an attitude and orientation which corresponds with the angle of inclination of said angularly inclined surface of said opposite end of said main body.

4. A method as in claim 3 wherein said sheet stock is applied at an angle to the horizontal in the neighborhood of 2° to 5°.

5. Rotary bending apparatus for use in a press comprising a notched rotor mounted on and for rotation in and with respect to a saddle, said saddle being contained in and for movement relative to a base member and a gage for positioning said saddle with reference to said base member constructed and arranged for insertion between adjacent side surfaces thereof, said gage being a segment of material corresponding in thickness to the thickness of the sheet material on which said rotor is to operate.

6. Rotary bending apparatus as in claim 5 wherein said base member includes a groove in its surface which is outermost in use thereof, said groove opening from one end of said member, said saddle serving as a base for said rotor and being formed for a slip fit mount in the groove of said base member from said one thereof and being contained at least in part within said base member between side walls of said groove for lateral movement with respect thereto and having at least one side surface portion thereof parallel to one side wall of said groove aand a set spacing with reference thereto as determined by said gage the thickness of which corresponds to that of the sheet material to be worked.

7. Rotary bending apparatus as in claim 5 wherein said saddle and the rotor mounted thereto are in a relatively projected relation to a surface of said base member which is outermost in use therof, said rotor is based in a groove in the surface of said saddle which is outermost in use thereof and the base of said groove in said saddle is uniformly arcuate in cross section, extends, in cross section, more than 180° and has a longitudinally extending recess therein oriented in a position substantially opposite of that area of the rotor through which force is applied thereto in the forming of material thereby.

8. Rotary bending apparatus as in claim 5 wherein said saddle and the rotor mounted thereto have a relatively projected relation to a surface of said base member which is outermost in its use and said rotor is based in a groove in the surface of said saddle which is outermost in use thereof, the base of said groove in said saddle is uniformly arcuate in cross section, extends, in cross section, more than 180° and has a longitudinally extending recess therein, said longitudinally extending recess, as viewed from one end thereof, being in a location which is in the area of a 4 to 5:30 clockwise position with reference to the central axis of said rotor.

* * * * *

UNITED STATES PATENT AND TRADEMARK OFFICE

CERTIFICATE OF CORRECTION

PATENT NO. : 4,535,619

DATED : August 20, 1985

INVENTOR(S) : Robert J. Gargrave

It is certified that error appears in the above-identified patent and that said Letters Patent is hereby corrected as shown below:

Col. 1, line 26, "appropriate" is corrected to read -- -- inappropriate --.

Col. 4, line 29, -- the lowermost surface portion of -- is inserted following "with";

line 35, -- end -- is inserted following "open".

Col. 5, line 55, -- a -- is inserted following "ing";

line 55, "to" is deleted.

Col. 8, line 1, "radical" is corrected to read -- radial --;

line 17, "describedd" is corrected to read -- described --.

Col. 9, line 23, -- and outwardly -- is inserted following "upwardly".

UNITED STATES PATENT AND TRADEMARK OFFICE

CERTIFICATE OF CORRECTION

PATENT NO. : 4,535,619

DATED : August 20, 1985

INVENTOR(S) : Robert J. Gargrave

It is certified that error appears in the above-identified patent and that said Letters Patent is hereby corrected as shown below:

Col. 10, line 19, -- or rocker -- is inserted following "rotor".

Col. 12, line 35 (Cl. 3, line 16) "diretion" is corrected to read -- direction --.

Col. 13, line 14 (Cl. 6, line 11) "aand" is corrected to read -- and --.

Signed and Sealed this

*Nineteenth* Day of *November 1985*

[SEAL]

*Attest:*

DONALD J. QUIGG

*Attesting Officer*

*Commissioner of Patents and Trademarks*